US005639186A

United States Patent [19]

Ferrari et al.

[11] Patent Number: 5,639,186

[45] Date of Patent: Jun. 17, 1997

[54] WATER FUNNEL

[76] Inventors: Lorenzo Ferrari; Renzo Ferrari, both of Guayabo 1932, Montevideo, Uruguay

[21] Appl. No.: 88,666

[22] Filed: Jul. 6, 1993

[30] Foreign Application Priority Data

Jul. 3, 1992 [UY] Uruguay ..... 23443

[51] Int. Cl.[6] ..... B63C 11/38

[52] U.S. Cl. ..... 405/194; 405/185

[58] Field of Search ..... 405/194, 193, 405/185; 114/264, 339, 340; 441/80

[56] References Cited

U.S. PATENT DOCUMENTS

| | | | |
|---|---|---|---|
| 0,019,785 | 3/1858 | Maillefert | 405/193 |
| 1,223,515 | 4/1917 | Papanastasiou | 405/193 X |
| 1,405,996 | 2/1922 | Freeze | 405/185 |
| 1,421,332 | 6/1922 | White | 405/185 |
| 1,866,438 | 7/1932 | Williamson | 405/194 |
| 3,076,205 | 2/1963 | Schultz | 114/264 X |
| 3,165,898 | 1/1965 | Elliott | 114/264 X |
| 3,738,113 | 6/1973 | Madary et al. | 114/264 X |

*Primary Examiner*—Dennis L. Taylor
*Attorney, Agent, or Firm*—Ladas & Parry

[57] ABSTRACT

A diving bell having a first funnel-shaped member which has a cone-shaped portion with a cylindrical portion projecting from an apex-most portion of the cone-shaped portion. A lid for sealing and unsealing egress and passage of air and water through opposite ends of the cylindrical portion of the first funnel-shaped member. A second funnel-shaped member having a cone-shaped portion with a cylindrical portion projects from an apex-most portion of the cone-shaped portion. The second funnel-shaped member being held about the first funnel-shaped member with a space between the first and second funnel-shaped members for receiving sand or the like.

8 Claims, 3 Drawing Sheets

WATER FUNNEL

BACKGROUND OF THE INVENTION

The invention relates to a funnel-shaped diving bell to provide a room for use underwater.

SUMMARY OF THE INVENTION

The invention for which patent is sought consists of three telescoped funnel-shaped members made of metal or any other resistant material. A fourth funnel-shaped member may be added for land transportation use.

DESCRIPTION OF THE EMBODIMENT

Figure 1:
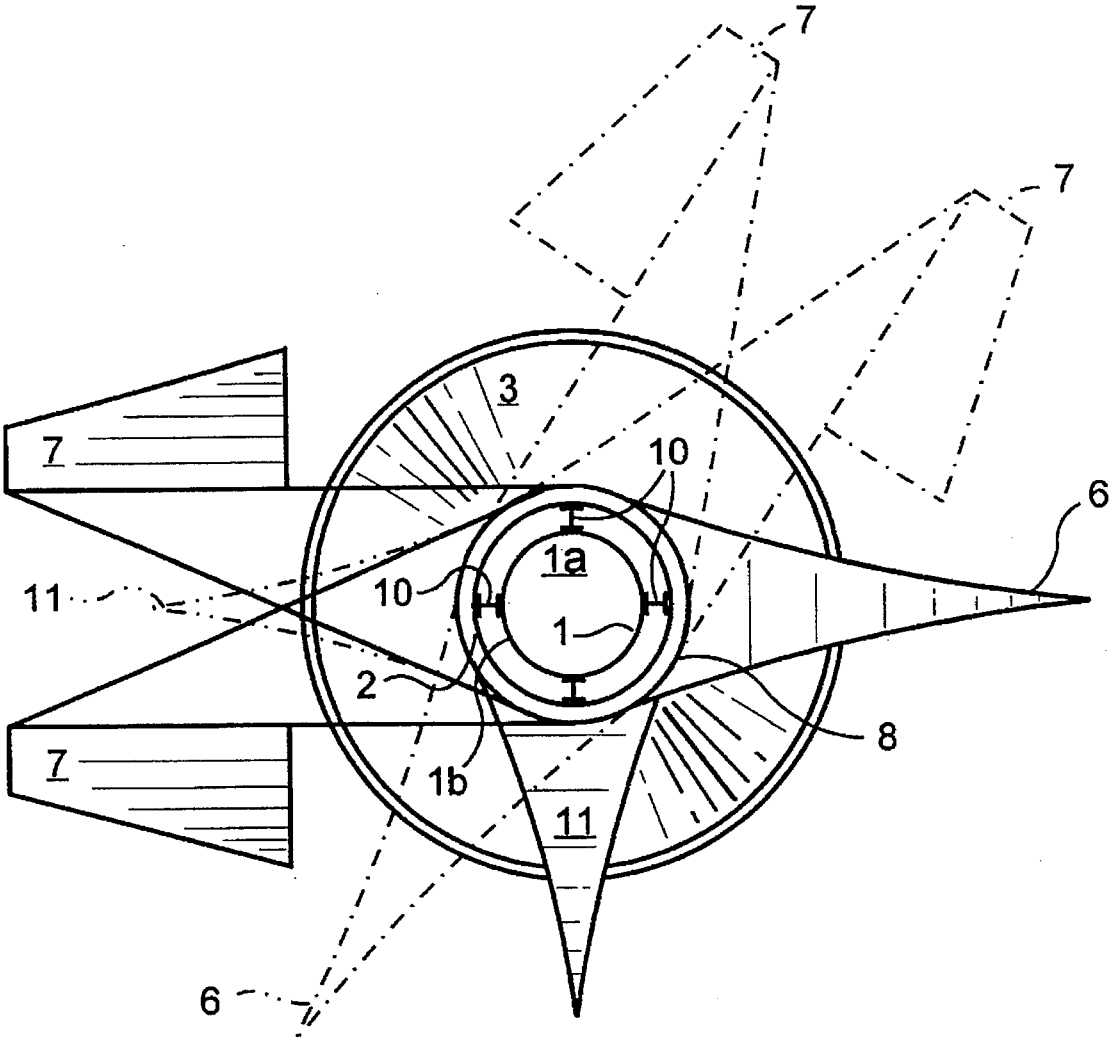
FIG. 1 is a top view of an embodiment.
Figure 2:
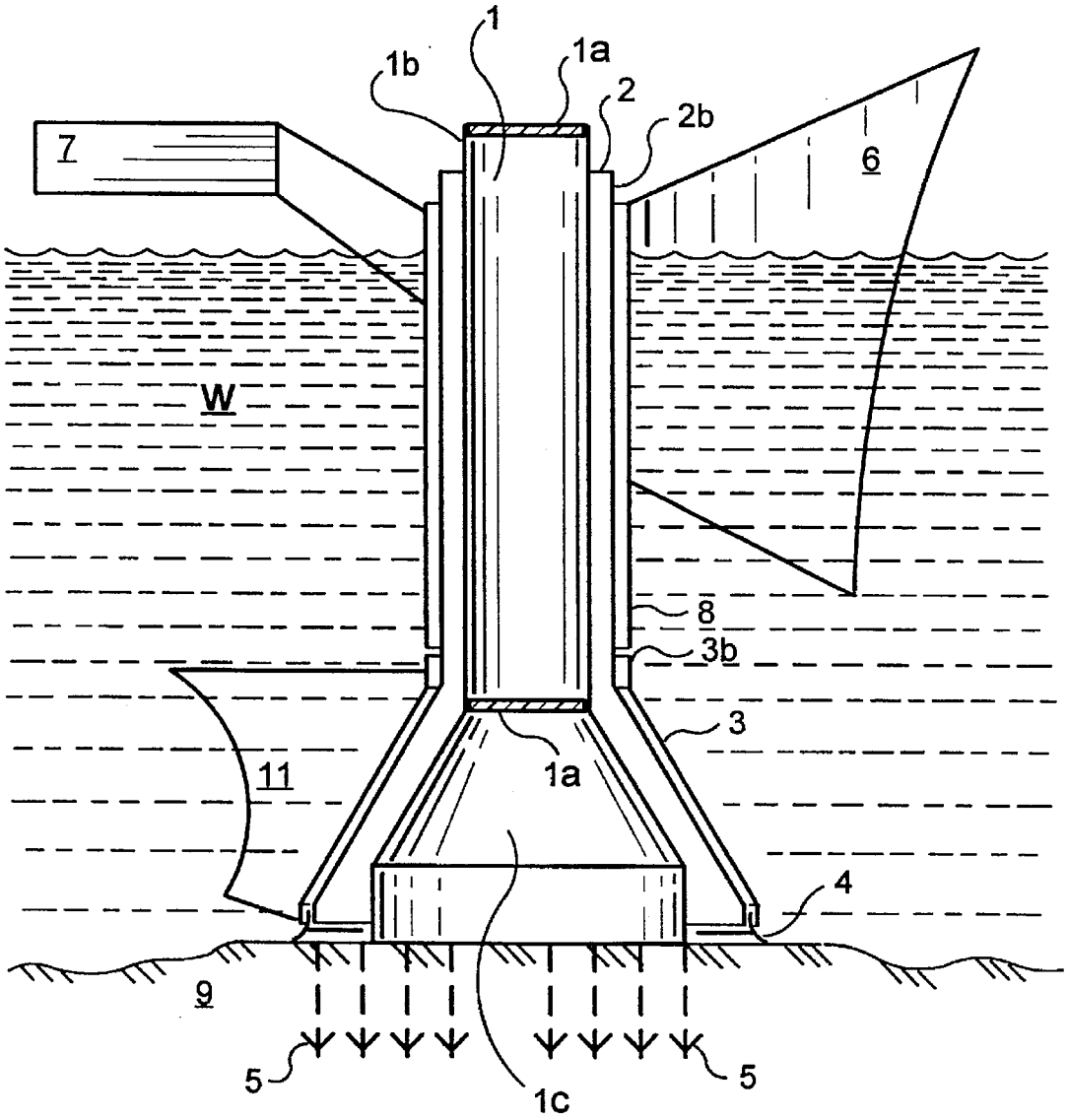
FIG. 2 is a schematic sectional side view of the embodiment in a vertical position for use.

As shown in the drawings, an inner funnel-shaped member 1 defines a room-size space at 1*c* capable of housing more than one person. The total height of the inner funnel-shaped member 1 is sufficient to project above the surface of water W in which it is used. Lids 1*a* are positioned respectively at opposite ends of a cylindrical portion 1*b* of the inner funnel-shaped member. The lids are made of fiberglass or similar material which can seal the cylindrical portion 1*b* when drawn on tight by means of screws (not shown). The lower lid has a valve which allows the entrance of water and the upper lid has a value which allows the exit of air.

An intermediate funnel-shaped member 2 of a diameter larger than that of the inner funnel-shaped member 1 surrounds the inner funnel-shaped member but has a lesser height of a cylindrical portion 2*b* as compared to the cylindrical portion 1*b* of the inner funnel-shaped member.

An outer funnel-shaped member 3 of a diameter larger than that of the intermediate funnel-shaped member 2 surrounds the intermediate funnel-shaped member but has a lesser height of a cylindrical portion 3*b* as compared to the cylindrical portions 1*b* and 2*b* of the inner and intermediate funnel-shaped members. On the internal side of a cone-shaped portion, the outer funnel-shaped member has injected polyurethane or any other adhesive material for thoroughly securing and holding a circular mantle 4.

Figure 4:
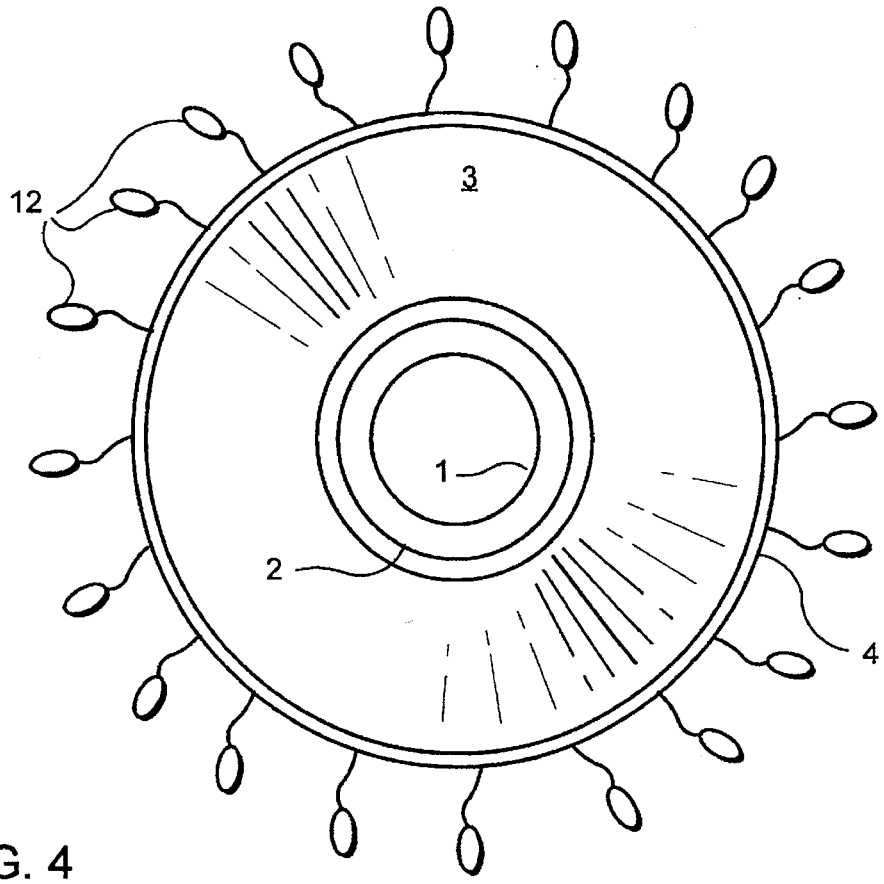
FIG. 4 is a partial bottom view of the embodiment with certain portions omitted and other, sandbag portions shown.

The circular mantle 4 has two layers of a resistant and impervious material and a central orifice through which the inner and intermediate funnel-shaped members 1 and 2 pass. It is a sort of giant lifesaver which can be inflated with air to make it float. On its periphery it has several rings (not shown) for connecting sandbags 12 (FIG. 4). Said mantle is held between the intermediate and outer funnels 2 and 3.

Two sets of anchoring points 5 are respectively welded to two metal rings (not shown) screwed on bases of the inner and intermediate funnel-shaped members 1 and 2 (one ring for each funnel-shaped member) to anchor them to an underwater platform 9 (FIG. 1).

A first prow 6 of fiberglass or similar material is rotatable about the cylindrical portion 2*b* of the intermediate funnel-shaped member for breaking waves and absorbing such thrust of the water W.

An aileron 7 is connected to the first prow 6 to guide the first prow with the wind so as to face the waves.

A cylinder 8 to which the prow 6 and aileron 7 are secured (glued or welded) rotates around the cylindrical portion 2*b* of the intermediate funnel-shaped member and his supported on the upper edge of the cylindrical portion 3*b* of the outer funnel-shaped member.

The inner and intermediate funnel-shaped members 1 and 2 are separated from each other by four or more double-T or I-shaped bars 10 (FIG. 1) which are welded only to the inner funnel-shaped member 1 along the cylindrical portion 1*b* thereof.

A second prow 11 (here of the same material as the first prow 6) is secured to the outer funnel-shaped member 3 by means of two rings (not shown) so that it can rotate. Said second prow 11 is beneath the first prow 6 and is provided for avoiding the effect of underwater currents. It can be controlled manually or by some automatic system (not shown).

Several plastic bags 12 full of sand each have a hook for insertion in the rings (not shown) of the mantle 4.

Figure 3:
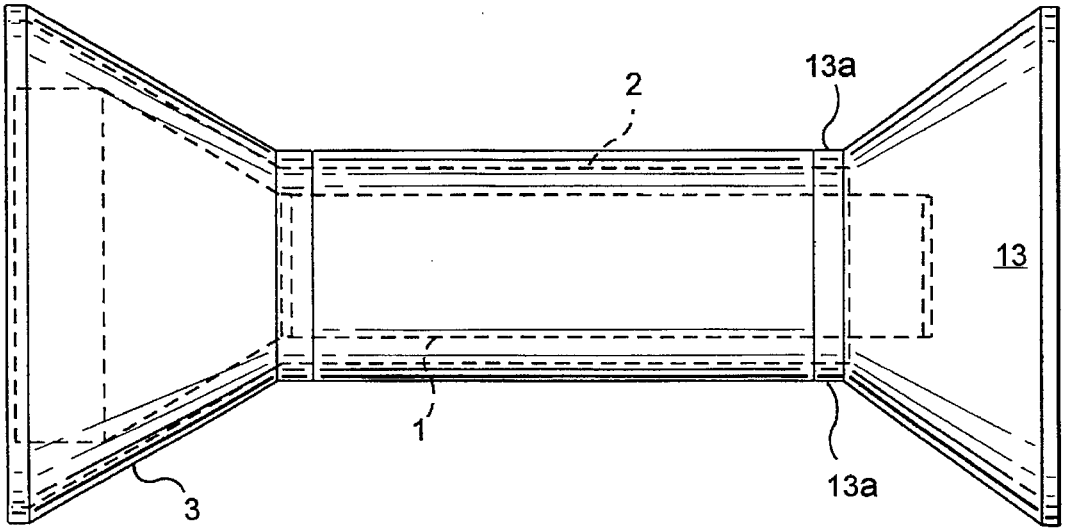
FIG. 3 is a side view of the embodiment in a different, horizontal position with an added, fourth funnel for land transportation use.

Another funnel-shaped member 13 identical with intermediate funnel-shaped member 2 but made of fiberglass and having a much smaller cylindrical portion (not shown) has several screws 13*a* (FIG. 3) for fixing the cylindrical portions of these funnel-shaped members together. The resulting spool shape is useful for moving the funnel-shaped members on land, for example from a road to the shore without need of any other vehicle.

Manner of Use

With the aid of the other funnel-shaped member 13, the members are rolled as if it were a spool of thread until reaching the water. The inner funnel-shaped member 1 then has its two lids 1*a* at the respectively opposite ends of its cylindrical portion 1*b* closed. Once in the water, therefore, the members float and the other funnel-shaped member 13 is removed, since it is no longer needed. The remaining members are then floated to the site where they are going to be used. The cylindrical portions 1*b*, 2*b* of the inner and intermediate funnel-shaped members are then vertically immersed with the cone-shaped portions of the funnel-shaped members downward in a manner controlled by the valves in the lids until the bottoms of the cone-shaped portions reach the bottom under the water and anchor by gravity.

Once the funnel-shaped members have been firmly secured, the mantle 4 is placed around them to rest on the bottom under the water with the aid of the bags 12 full of sand which hang from its edges. The mantle is then secured with the cone-shaped base of the outer funnel-shaped member 3, which carries the second prow 11 around it. Then the cylinder 8, which has the first prow 6 and aileron 7 thereon, is inserted onto the cylindrical portion 2*b* of the intermediate funnel-shaped member. Sand is then injected in the space left between the inner and intermediate funnels-shaped members 1 and 2 up to the top of the cylindrical portion 2*b*. The upper lid is then removed and the water contained in the cylindrical portion 1*b* of inner funnel-shaped member 1 is extracted completely. The lower lid is then removed and the cone-shaped portion of the inner funnel-shaped member 1 also emptied of water. In this situation there is obtained an area (room) 1*c* available for the desired use.

If a water pump (not shown) has been used to extract the water, said pump could be programmed to be automatically re-started should water seep under the bottom. Another method for preventing the water from entering from below is to insert freezing probes (not shown) in the subsoil which constitutes the bottom of the room and in this manner the water that was going to seep in is frozen to block the inlet and as any excavation from the room progresses, hot water is ejected only at the sites where needed for this.

We claim:

1. A funnel-shaped diving bell, comprising:

a first funnel-shaped member (1) having a cone-shaped portion (1*c*) with a cylindrical portion (16) projecting from an apex-most portion of the cone-shaped portion;

lid means (1*a*) for sealing and unsealing egress and passage of air and water through opposite ends of the cylindrical portion of the first funnel-shaped member; and a second funnel-shaped member having a cone-shaped portion with a cylindrical portion projecting from an apex-most portion of the cone-shaped portion, the second funnel-shaped member being held about the first funnel-shaped member with a space between the first and second funnel-shaped members for receiving sand or the like.

2. The funnel-shaped diving bell according to claim 1, and further comprising:

a first prow (6);

prow-mounting means (8) for mounting the first prow rotatably about the cylindrical portion of the second funnel-shaped member; and aileron means (7) for rotating the first prow in response to wind, whereby the first prow faces and dissipates water wave energy in use.

3. The funnel-shaped diving bell according to claims, and further comprising:

a third funnel-shaped member (3) having a cone-shaped portion about the cone-shaped portion of the second funnel-shaped member and a cylindrical portion about and shorter than the cylindrical portion of the second funnel-shaped member for supporting the prow-mounting means.

4. The funnel-shaped diving bell according to claim 3, and further comprising:

a second prow (11) on the cone-shaped portion of the third funnel-shaped member for facing and dissipating underwater current.

5. The funnel-shaped diving bell according to claim 1, and further comprising:

another funnel-shaped member having a cone-shaped portion with a cylindrical section projecting from an apex-most portion of the cone-shaped portion; and connection means (13*a*) for connecting the first and other funnel-shaped members cylindrical portion to cylindrical portion into a spool shape for rolling movement.

6. The funnel-shaped diving bell according to claim 2, and further comprising:

another funnel-shaped member having a cone-shaped portion with a cylindrical section projecting from an apex-most portion of the cone-shaped portion; and connection means (13*a*) for connecting the first and other funnel-shaped members cylindrical portion to cylindrical portion into a spool shape for rolling movement.

7. The funnel-shaped diving bell according to claim 3, and further comprising:

another funnel-shaped member having a cone-shaped portion with a cylindrical section projecting from an apex-most portion of the cone-shaped portion; and connection means (13*a*) for connecting the first and other funnel-shaped members cylindrical portion to cylindrical portion into a spool shape for rolling movement.

8. The funnel-shaped diving bell according to claim 4, and further comprising:

another funnel-shaped member having a cone-shaped portion with a cylindrical section projecting from an apex-most portion of the cone-shaped portion; and connection means (13*a*) for connecting the first and other funnel-shaped members cylindrical portion to cylindrical portion into a spool shape for rolling movement.

* * * * *